United States Patent [19]

Kelch

[11] 4,040,161

[45] Aug. 9, 1977

[54] APPARATUS AND METHOD FOR REMOVING A PLURALITY OF BLADE DIES

[75] Inventor: George W. Kelch, Palm Beach, Fla.

[73] Assignee: United Technologies Corporation, Hartford, Conn.

[21] Appl. No.: 635,188

[22] Filed: Nov. 25, 1975

[51] Int. Cl.[2] ..... B21D 45/00; B22D 17/00

[52] U.S. Cl. ..... 29/239; 72/344; 164/404

[58] Field of Search ..... 164/344, 404; 425/DIG. 5; 29/200 D, 427, 239; 72/344, 427

[56] References Cited

U.S. PATENT DOCUMENTS

| | | | |
|---|---|---|---|
| 3,461,502 | 8/1969 | Turk | 425/DIG. 5 |
| 3,464,090 | 9/1969 | Cantarutti | 425/DIG. 5 |

*Primary Examiner*—Jimmy C. Peters
*Attorney, Agent, or Firm*—Jack N. McCarthy

[57] ABSTRACT

A method is disclosed of removing a plurality of rim blade dies around the circumference of a disc while the disc, blades and blade dies are at a temperature approximating those during the forging operation. The upper disc forming die is removed along with a restraining back-up member around the rim blade dies and the rim blade dies are forced radially outwardly to prevent interference between the blade dies and blades during their cool down period. A blade die removal tool has a plurality of individual radial arms extending outwardly from a central hub. The free ends of the arms engage the blade dies and the ram of the press moves the central hub downwardly to move the blade dies radially outwardly.

10 Claims, 5 Drawing Figures

APPARATUS AND METHOD FOR REMOVING A PLURALITY OF BLADE DIES

The invention herein described was made in the course of or under a contract with the Department of the Air Force.

BACKGROUND OF THE INVENTION

This invention relates to removing rim blade dies from blades on a disc which are at forging temperatures. While a work piece holder having the ability to change its diametral dimension is described in U.S. Pat. No. 2,734,750 this invention defines thereover. Rim blade dies are shown in U.S. Pat. No. 3,122,823.

SUMMARY OF THE INVENTION

It is an object of this invention to provide a method of loosening and retracting rim blade dies around the circumference of a disc while the disc, blades and rim blade dies are at a temperature approximately those during the forging operation and in a controlled atmospheric environment, and moving them radially outwardly to prevent any mechanical interference between the forged blades and blade dies during the cool down period as a result of thermal contraction of the die and forged part.

It is a further object of this invention to provide a rim blade die removal tool which has a plurality of radial arms extending outwardly from a central hub which is re-usable and unaffected by forging temperatures. The ends of said arms engaging the dies while the ram engages the central hub.

DESCRIPTION OF THE PREFERRED EMBODIMENT

Figure 2:
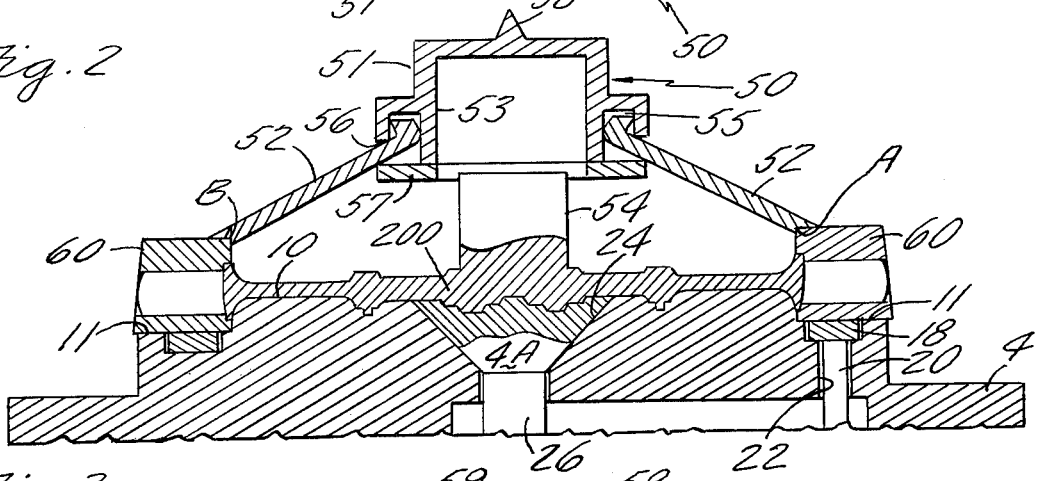
FIG. 2 is a sectioned view along the line 2—2 of FIG. 1.
Figure 3:
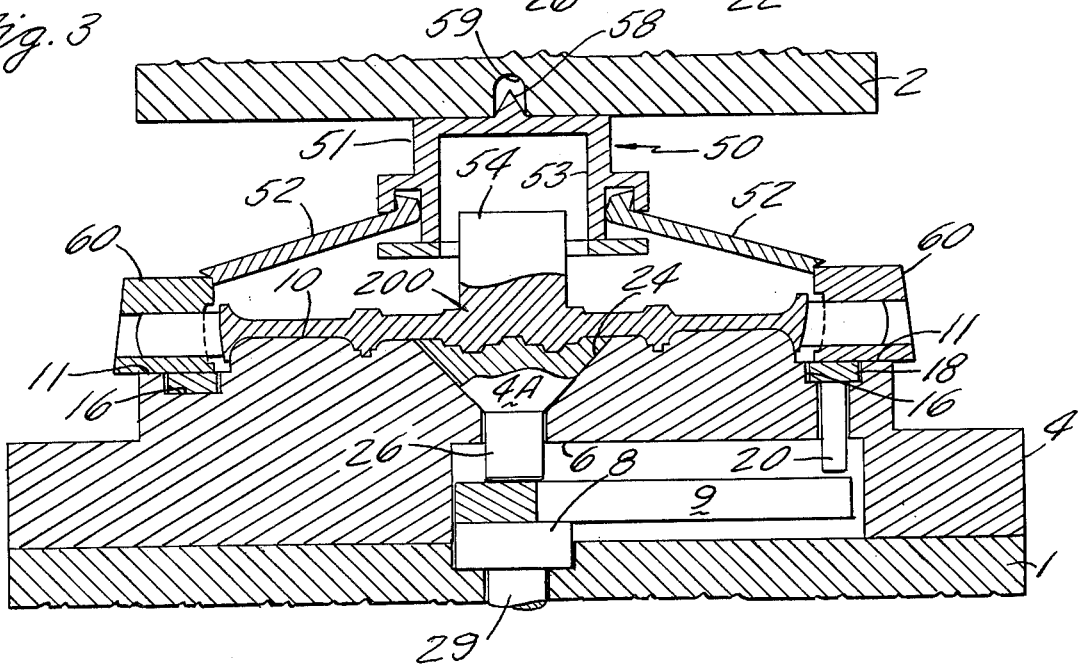
FIG. 3 is a view similar to FIG. 2 where the ram has moved the rim blade die removal tool to a position where the rim dies have been moved radially outwardly.

In FIGS. 2 and 3 a lower die 4 is shown fixed on a press bed 1. The lower die 4 has an opening 6 in the bottom side thereof which has three equally spaced extending grooves to receive a knockout pin head 8 which has three arms 9 spaced 120° apart. The knockout head 8 is fixed to the top of a knockout pin 29. This pin 29 extends through the bed 1 and can be actuated by any means desired when necessary. The lower die 4 comprises an upper surface 10 contoured to the finished configuration of a disc. A flat annular surface 11 extends around the contoured face of the die and receives the rim blade dies 60.

An annular recess 16 extends around the annular face 11 and contains a ring member 18. The ring member 18 has three pins 20 fixed thereto which extend downwardly therefrom at three parts equally spaced about the ring member. These pins extend through openings 22 in the lower die 4 to be positioned adjacent the ends of the arms 9 of the knockout pin head 8.

The center of the lower die 4 has a conical recess 24 at the center thereof with a center portion 4A positioned therein. A short shaft portion 26 extends downwardly therefrom through an opening in the center of the lower die 4 to a point adjacent the center of the knockout pin head 8. As can be seen in FIGS. 2 and 3 the contour of the upper surface 10 carries across over both parts of the lower die 4 and insert 4A.

After the forging operation, a finally formed disc 200 with blades remains positioned over the surface 10 and with the blades in the rim blade dies 60. The upper dies used for final forming are not shown. A method of forging a disc with integral blades is disclosed in Application Ser. No. 635,181 filed herewith to David Beane, et al.

To remove the rim blade dies 60 a removal tool 50 is positioned over the formed disc 200 with blades and the rim blade dies 60. The blade die removal tool 50 comprises a central hub 51 with a plurality of individually removable arms 52 extending radially therefrom. The central hub 51 is formed having an opening 53 therein to receive a shaft projection 54 on a finished disc if necessary. The inner ends of the arms 52 are located in an annular chamber 55 around the lower part of the central hub 51, with the arms 52 projecting through an annular opening means 56. The inner ends are bent to prevent them from falling out of the chamber 55. The ends can be formed having other enlarged shapes as is known in the art. The bottom 57 of the central hub 51 is removable so the ends of the arms can be placed in the chamber. This also provides for changing the arms if necessary.

The outer ends of the arms 52 are notched at A to engage the inner edge B of the plurality of blade dies 60. FIG. 2 shows the removal tool 50 resting in position prior to a ram force being applied. The upper part of the central hub 51 has a conical positioning pilot 58 for engaging a centering recess 59 in a ram 2. A pilot 58 can be configured to engage an upper die if it is desirable to let the upper die remain in place. contacting surfaces of the removal tool are coated with boron nitride to prevent sticking and wear. FIG. 3 shows the removal tool 50 positioned with the rim blade dies 60 moved radially outward where they cannot interfere with the cooling of the blades. The ram 2 was actuated to press the central hub 51 downwardly and outer ends of the arms 52 with the notches A outwardly.

Figure 1:
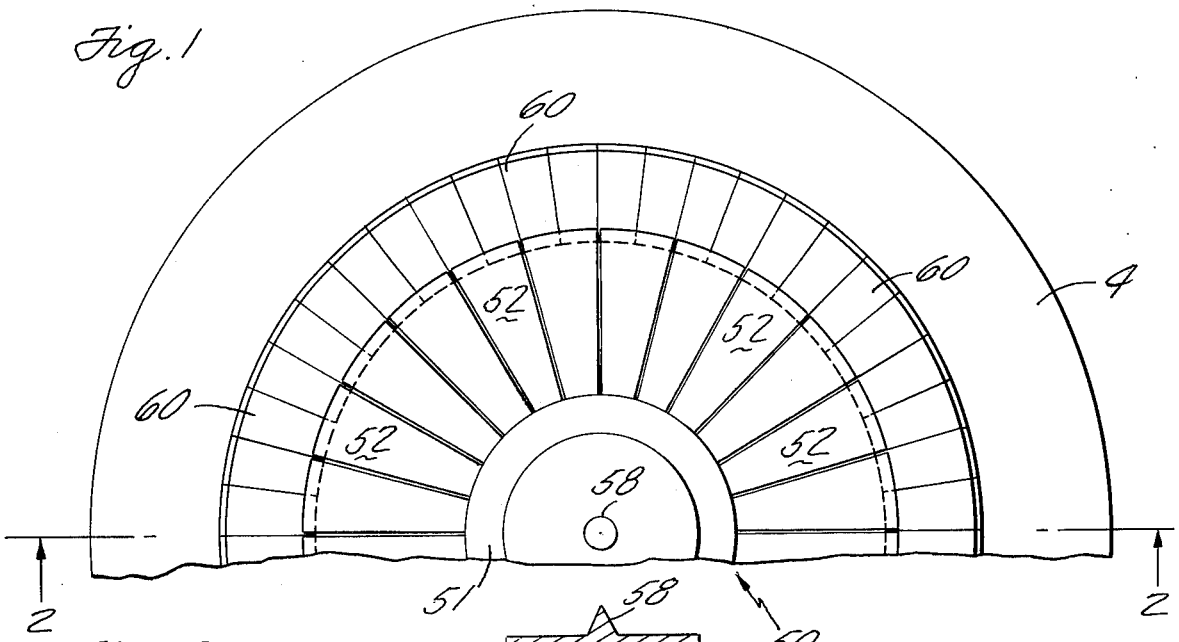
FIG. 1 is a fragmentary top view of the rim blade die removal tool in place on a finally formed disc having blades with the lower die and rim blade dies in place.
Figure 4:
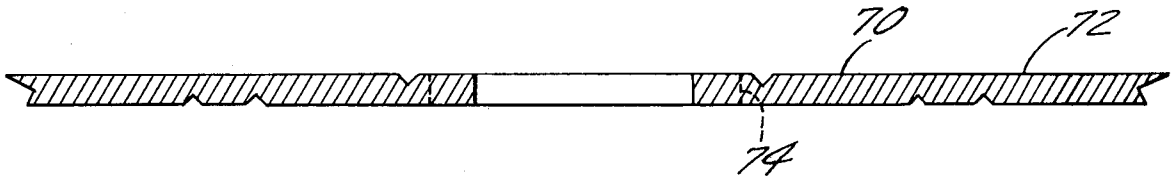
FIG. 4 is a view showing the formation of the disc member for a modification of the rim blade die removal tool.
Figure 5:
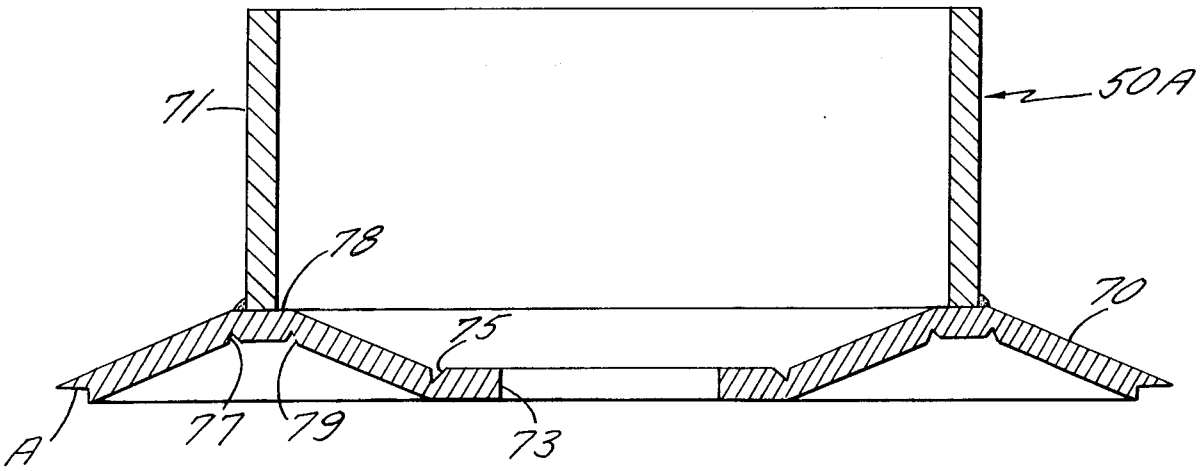
FIG. 5 is a view showing the modification arranged with a cylindrical hub for use on a finally formed disc with the rim blade dies in place.

A modification of a blade die removal tool 50A is shown in FIGS. 4 and 5. This tool comprises a disc member 70 and a cylindrical hub 71. The disc member 70 is formed into a plurality of radial fingers 72 by a plurality of radial cuts 74. A central opening 73 is placed in disc 70 for the same purposes as the opening 53 in the modification shown in FIGS. 1 -3.

To position the disc member 70 for use, a plurality of circumferential Vee grooves acting as metal hinges are placed in the surfaces thereof, one Vee groove 75 is placed on the upper surface adjacent the central opening 73 and two Vee grooves 77 and 79 are placed a short distance apart at a mid point between the outer periphery and the edge of the opening 73. A notch A is placed on the outer ends of the fingers 72 in the same manner as in the arms 52.

The cylindrical hub 71 has a diameter so that it engages the upper flat annular portion 78 of the disc member 70 formed by the Vee grooves 77 and 79. The cylindrical hub 71 is tack welded to the disc member 70 so that as the cylindrical hub 71 is pressed downwardly and the disc member 70 flattens, the tack welds will break in a predetermined pattern to a rigid weld on one side.

I claim:

1. A rim blade die removal tool comprising a central hub having a plurality of arms extending radially therefrom, means pivotally connecting one end of each of said arms to said central hub, the outer ends of said arms being contoured, each end of each arm being contoured for engaging an inner surface of one die of a plurality of rim blade dies and moving them radially outwardly when the central hub is moved axially.

2. A combination as set forth in claim 1 including in combination a bottom die, a formed disc with blades on said bottom die, rim blade dies on said blades, said rim blade dies having inner surfaces, the outer contoured ends of said arms engaging the inner surfaces of said rim blade dies, means for moving said central hub downwardly for moving the rim blade dies radially outwardly.

3. An apparatus as set forth in claim 1 wherein th outer ends of said arms are notched, each notched end of each arm for engaging an inner surface of one of said rim blade dies, said inner surfaces forming a segmented circular edge.

4. An apparatus as set forth in claim 1 wherein said central hub has an annular chamber therearound, each of said arms having an enlarged inner end positioned in said chamber, said arms extended through an opening in the chamber wall.

5. An apparatus as set forth in claim 4 wherein a wall of said chamber is removeable to remove said arms.

6. An apparatus as set forth in claim 2 wherein the lower portion of the central hub is contoured to receive projections which may extend upwardly from a formed disc.

7. An expendable blade die removal tool comprising a central hub, said hub having a plurality of arms, each of said arms extending radially therefrom, the outer ends of said arms having means for engaging a plurality of rim blade dies, said arms having metal hinges such that the outer ends of said arms engaging a plurality of rim blade dies can move them radially outward when the central hub is moved axially.

8. An apparatus as set forth in claim 7 wherein said arms are formed on a disc which has been radially slotted, said disc having a plurality of Vee grooves forming metal hinges so that the disc can be positioned having a raised center portion, said center hub being cylindrical and having one end tack welded to the raised center portion of the disc.

9. An apparatus as set forth in claim 8 wherein said tack welds are made in a predetermined pattern so that it will break around the circumference to a strong weld on one side.

10. A combination as set forth in claim 1 including in combination a bottom die, rim blade dies positioned on said bottom die, said rim blade dies having inner surfaces, each outer contoured end of each of said arms engaging the inner surface of one of said rim blade dies, means for moving said central hub towards said bottom die to move the rim blade dies radially outwardly.

* * * * *